US010393380B2

(12) United States Patent
Riehle

(10) Patent No.: US 10,393,380 B2
(45) Date of Patent: Aug. 27, 2019

(54) COMBUSTOR CASSETTE LINER MOUNTING ASSEMBLY

(71) Applicant: Rolls-Royce North American Technologies, Inc., Indianapolis, IN (US)

(72) Inventor: Bradford John Riehle, Plainfield, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 318 days.

(21) Appl. No.: 15/208,290

(22) Filed: Jul. 12, 2016

(65) Prior Publication Data

US 2018/0017257 A1 Jan. 18, 2018

(51) Int. Cl.

| | |
|---|---|
| ***F23R 3/00*** | (2006.01) |
| ***F23R 3/60*** | (2006.01) |
| ***F23R 3/50*** | (2006.01) |

(52) U.S. Cl.

CPC ..... *F23R 3/002* (2013.01); *F23R 3/007* (2013.01); *F23R 3/50* (2013.01); *F23R 3/60* (2013.01); *F23R 2900/00017* (2013.01)

(58) Field of Classification Search

CPC . F01D 9/023; F01D 9/04; F01D 9/047; F02C 7/20; F05D 2260/30; F23R 3/002; F23R 3/007; F23R 3/42; F23R 3/425; F23R 3/44; F23R 3/46; F23R 3/50; F23R 3/52; F23R 3/54; F23R 3/58; F23R 3/60; F23R 2900/00005; F23R 2900/00012; F23R 2900/00017

See application file for complete search history.

(56) References Cited

U.S. PATENT DOCUMENTS

| | | | | |
|---|---|---|---|---|
| 3,286,461 | A * | 11/1966 | Johnson | F01D 5/081 415/116 |
| 4,614,082 | A | 9/1986 | Sherman et al. | |
| 5,417,545 | A | 5/1995 | Harrogate | |
| 5,839,878 | A | 11/1998 | Maier | |

(Continued)

FOREIGN PATENT DOCUMENTS

| | | |
|---|---|---|
| EP | 2 886 962 A1 | 6/2015 |
| GB | 597165 | 1/1948 |

OTHER PUBLICATIONS

Extended European Search Report, dated Dec. 1, 2017, European Application No. 17176960.7, pp. 1-11, European Patent Office Munich, Germany.

(Continued)

*Primary Examiner* — Scott J Walthour
(74) *Attorney, Agent, or Firm* — Brinks Gilson & Lione

(57) ABSTRACT

Disclosed herein are examples of gas turbine engines and assemblies of combustors and turbine nozzles for such gas turbine engines. The combustor wall includes an inner wall, an outer wall, and an upstream dome. The combustor outer wall and/or inner wall may comprise of a plurality of combustor cassettes. A turbine nozzle is defined by an inner nozzle shroud and an outer nozzle shroud. An inner edge of a ring mount is coupled to both of the downstream end of the outer wall and the nozzle upstream end of the outer nozzle shroud, and an outer edge of the ring mount is coupled to the outer casing, such as, for example, by a mounting stake.

17 Claims, 7 Drawing Sheets

(56) References Cited

U.S. PATENT DOCUMENTS

| | | | |
|---|---|---|---|
| 5,970,716 | A | 10/1999 | Forrester et al. |
| 6,347,508 | B1 | 2/2002 | Smallwood et al. |
| 7,866,939 | B2 | 1/2011 | Harper et al. |
| 8,752,395 | B2 | 6/2014 | McCormick et al. |
| 2002/0184886 | A1 | 12/2002 | Calvez et al. |
| 2006/0032235 | A1 | 2/2006 | Aumont et al. |
| 2006/0032237 | A1 | 2/2006 | Aumont et al. |
| 2007/0186559 | A1 | 8/2007 | De Sousa et al. |
| 2009/0038311 | A1 | 2/2009 | Snook et al. |
| 2011/0056055 | A1 | 3/2011 | Gendraud et al. |
| 2014/0250894 | A1 | 9/2014 | Petty, Sr. et al. |
| 2014/0360196 | A1 | 12/2014 | Graves et al. |

OTHER PUBLICATIONS

European Office Action, dated Oct. 22, 2018, pp. 1-4, issued in European Patent Application No. 17 176 960.7, European Patent Office, Rijswijk, The Netherlands.

European Office Action, dated Jun. 5, 2019, pp. 1-5, issued in European Patent Application No. 17 176 960.7, European Patent Office, Rijswijk, The Netherlands.

* cited by examiner

COMBUSTOR CASSETTE LINER MOUNTING ASSEMBLY

TECHNICAL FIELD

This disclosure relates to combustors for gas turbine engines, and in particular to combustor liner mounting assemblies for use in combustors of gas turbine engines.

BACKGROUND

Gas turbine engines include a combustor where a mixture of fuel and air is ignited to complete a combustion process. Air is typically compressed by an upstream compressor system before being provided to the combustor. The combustor receives the compressed air and adds fuel to the air, which is then ignited to produce hot, high pressure gas. After the combustion process, the combustor directs the gas to a downstream turbine through the turbine nozzle.

Because of the heat generated within the combustor during the combustion process, liners are disposed along the combustor wall and are made of materials to withstand the high-temperature cycles. Typical liners are made of metallic superalloys formed in solid cylindrical structures having high hoop strength to surround the combustor barrel housing. However, the metal liners (or metal cans) require significant cooling to be maintained at or below their maximum use temperatures. Instead of the solid cylindrical liner configuration, segmented liner panels have been explored. These liner panels, typically made of, for example, ceramic matrix composites (CMC), may be fitted together around the combustor barrel housing. Although liner panels improve the combustor's ability to withstand the high-temperature cycles, they lack hoop strength integrity when compared to metal liner cans. Also, the interface between the combustor discharge of the combustor with liner panels and the turbine nozzle require complicated interfaces and seal arrangements due to the relative motion between the liner and the nozzle. Therefore, present approaches for mounting a combustor having liner panels to a turbine nozzle suffer from a variety of drawbacks, limitations, and disadvantages. There is a need for the inventive mounting assemblies, systems and methods disclosed herein.

BRIEF SUMMARY

An assembly for a gas turbine engine disposed about a longitudinal axis is disclosed herein. The assembly includes a combustor and a turbine nozzle. The combustor includes a combustor wall including an inner wall, an outer wall, and an upstream dome coupled to the outer wall and the inner wall. A turbine nozzle is defined by an inner nozzle shroud and an outer nozzle shroud. A ring mount includes an inner edge and an outer edge. The inner edge is coupled to a downstream end of the outer wall and to a nozzle upstream end of the outer nozzle shroud. The outer edge is coupled to an outer casing of the combustor. In some examples, the inner wall, the outer wall, or both, may comprise of a plurality of combustor cassettes.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Disclosed herein are examples of gas turbine engines and combustion systems that may be used in any industry, such as, for example, to power aircraft, watercraft, power generators, and the like. Instead of the solid cylindrical liner configuration, the combustor liner may be comprised of segmented liner panels or combustor cassettes fitted together in an arrangement. The combustor cassettes may be made of ceramic matrix composite (CMC) material or other materials to improve the service life of the combustor. Although combustor cassettes have shown improvement in the combustor's ability to withstand high-temperature cycles, the cassettes when fitted together lack hoop strength and structural integrity. New and improved joint assemblies between the upstream dome and the combustor cassette liners and between the combustor cassette liner discharge and the turbine nozzle inlet are disclosed herein. The assemblies may improve the hoop strength and structural integrity of combustors with cassette liners and may accommodate any relative motion between the combustor liner and the turbine nozzle due to thermal expansion and contraction during the thermal cycle operation of gas turbine engine.

Figure 1:
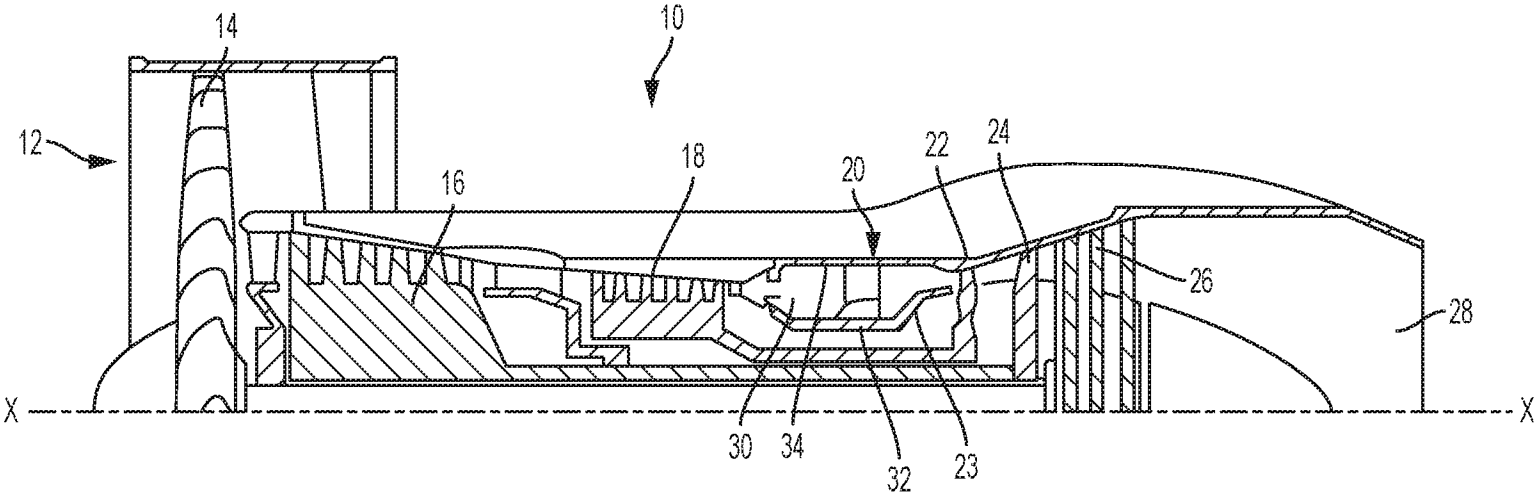
FIG. 1 illustrates a gas turbine engine disposed about a longitudinal axis X-X.

With reference to FIG. 1 a gas turbine engine generally indicated at 10 includes, in axial flow series, an air intake 12, a propulsive fan 14, an intermediate pressure compressor 16, a high pressure compressor 18, combustion equipment 20, turbine(s) (a high pressure turbine 22, an intermediate pressure turbine 24, a low pressure turbine 26) and an exhaust nozzle 28.

The gas turbine engine 10 works in the conventional manner so that air entering the air intake 12 is accelerated by the fan 14 to produce two air flows, a first air flow into the intermediate pressure compressor 16 and a second airflow which provides propulsive thrust. The intermediate pressure compressor 16 compresses the air flow directed into it before delivering the air to the high pressure compressor 18 where further compression takes place.

Figure 2:
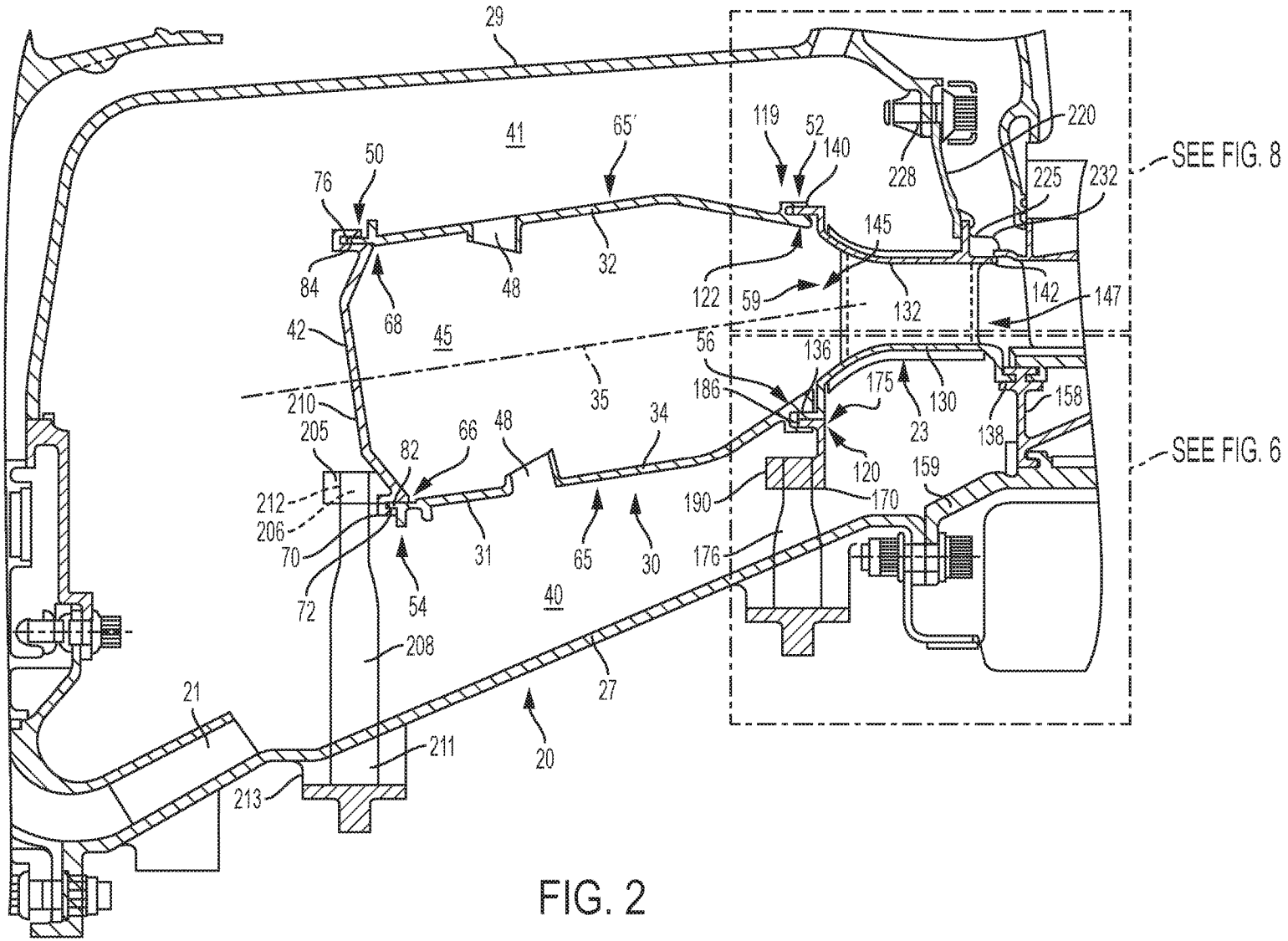
FIG. 2 illustrates an example of an assembly including a combustor and a turbine nozzle for the gas turbine engine of FIG. 1.

With additional reference to FIG. 2, the compressed air exhausted from the high pressure compressor 18 is directed into the combustion equipment 20 via a diffuser inlet 21 where the compressed air is mixed with fuel and the mixture combusted. The resultant hot combustion products then expand through and thereby enter via a turbine nozzle 23 and drive the high, intermediate and low pressure turbines 22, 24 and 26 before being exhausted through the exhaust nozzle 28 to provide additional propulsive thrust. The high, intermediate and low pressure turbines 22, 24 and 26 respectively drive the high and intermediate pressure compressors 16 and 18 and the fan 14 by suitable interconnecting shafts.

Fuel is directed into the combustor 30 through a number of fuel injectors (not shown) located at the upstream end of the combustor 30. The fuel injectors are circumferentially spaced around the engine 10 and serve to provide fuel into air derived from the high pressure compressor 18. The resultant fuel and air mixture is then combusted within the combustor 30.

An outer casing 27 and an inner casing 29 of the combustion equipment 20 extends circumferentially about and axially along a longitudinal axis (X-X) of the engine 10. The outer and inner casings 27, 29 surround the combustor 30 in a manner to define an annular outer plenum 40 therebetween and an annular inner plenum 41 therebetween, respectively. With additional reference to FIG. 3, the combustor 30 includes a combustor wall 31 being defined by an annular combustor upstream dome 42 interconnected between a tubular combustor inner wall structure 32 and a tubular combustor outer wall structure 34. The inner wall structure 32 and the outer wall structure 34 each may be extended circumferentially about and axially downstream along a longitudinal axis (X-X) of the engine 10 the upstream dome 42 towards the turbines, thereby defining a combustion chamber 45. The combustion chamber 45 may be defined about a combustor axis 35 of the combustor 30. The upstream dome 42, the inner wall structure 32 and the outer wall structure 34 may be constructed as a multi-walled structure. For example, the inner wall structure and the outer wall structure, respectively, may include a shell layer, a combustor liner, and one or more cooling impingement cavities. Quench openings 48 may be formed in the inner and/or outer wall structures 32, 34 circumferentially around the longitudinal axis of the engine. The quench openings 48 formed in the inner and outer wall structures may be arranged to face one another. Additional quench openings (not shown) may be located further downstream of the quench openings 48.

Figure 3:
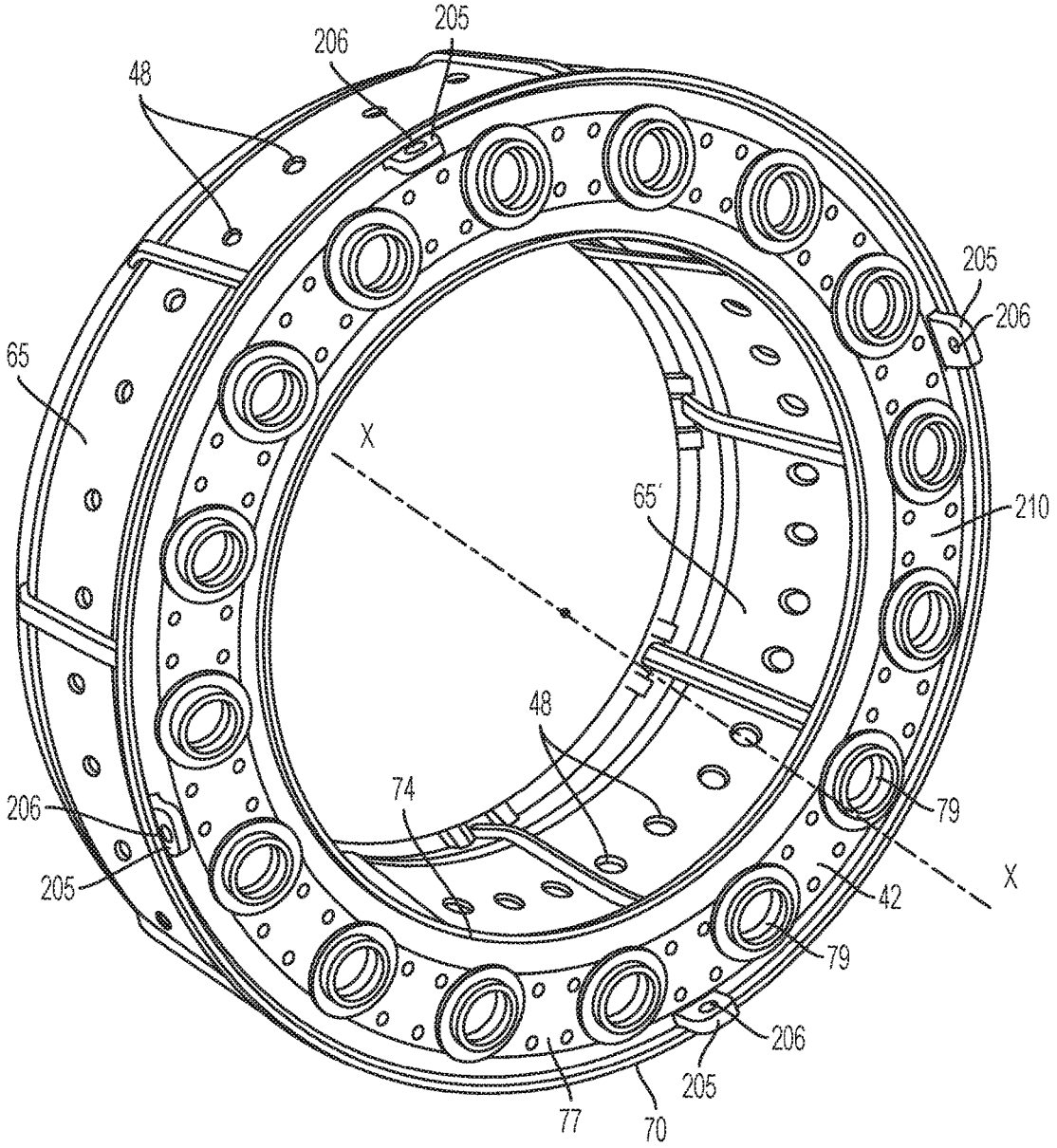
FIG. 3 is a perspective view of a portion of a combustor.
Figure 4:
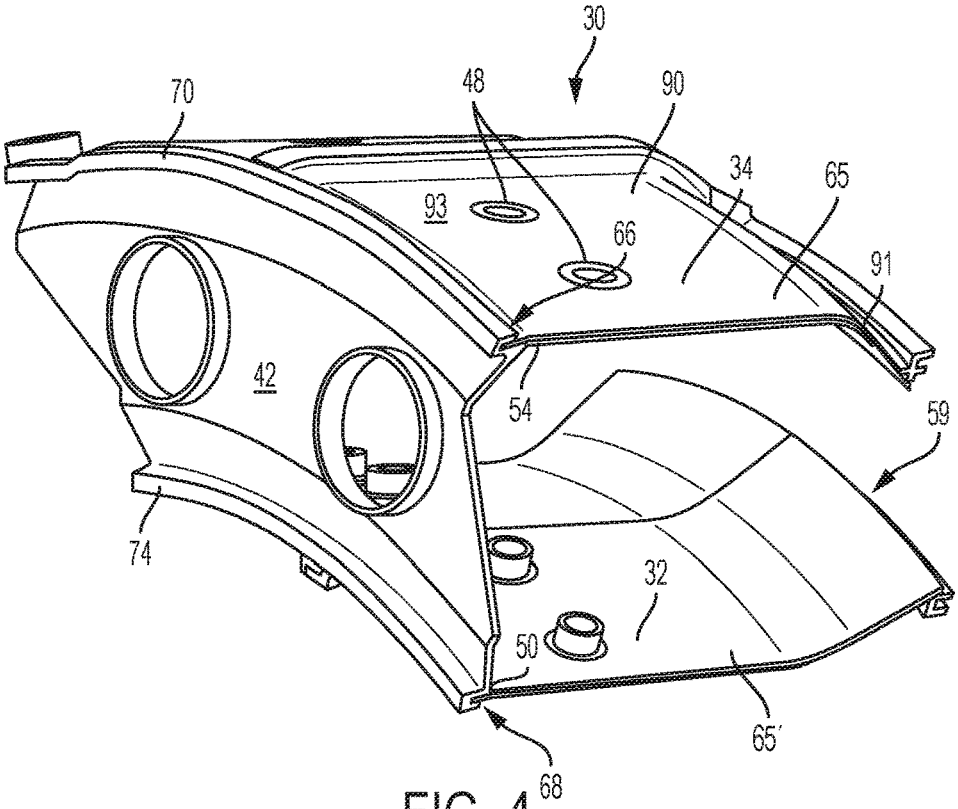
FIG. 4 is a perspective view of a partial segment of a combustor.

The inner wall structure 32 extends between an upstream end 50 coupled to the upstream dome 42 and a downstream end 52 coupled to the turbine nozzle 23. The outer wall structure 34 extends between an upstream end 54 coupled to the upstream dome 42 and a downstream end 56 coupled to the turbine nozzle 23. The respective downstream ends 52, 56 together define a combustor discharge end 59. The inner wall structure 32, the outer wall structure 34, or both may be assembled from a plurality of combustor cassettes 65 coupled to one another in an arrangement between the upstream dome 42 and the turbine nozzle 23, as will be described. FIGS. 3-4 illustrates one example of annular arrangements of cassettes 65 that define each of the inner wall structure 32 and the outer wall structure 34.

FIG. 4 depicts a partial segment of the combustor 30, illustrating an outer dome coupling 66 and an inner dome coupling 68 between the upstream dome 42 and the inner wall structure 32 and the outer wall structure 34. The upstream ends 50, 54 of the inner wall structure 32 and the outer wall structure 34, respectively, may be formed with means to be attached to and axially and radially supported by the upstream dome 42. With reference to FIG. 3, the upstream dome 42 is shown including an annular body 77 spanning between an outer edge 70 and an inner edge 74. The body 77 may further include a series of apertures 79 formed therein and circumferentially spaced from one another to receive additional combustion components (not shown) such as but not limited to swirlers, fuel injection systems, and the like as appreciated by those of ordinary skill in the art.

In one example shown in FIG. 2, the outer edge 70 of the upstream dome 42 may include a slot 72 to receive an axial lip 82 formed along the upstream end 54 of the outer wall structure 34 to define the outer dome coupling 66. The inner edge 74 of the upstream dome 42 may include a slot 76 to receive an axial lip 84 formed along the upstream end 50 of the inner wall structure 32 to define the inner dome coupling 68. The outer and inner dome couplings 66, 68 may be adapted to improve the hoop strength and integrity of the outer and inner wall structures 34, 32 along its upstream end, respectively, and adapted to permit movement and growth due to the thermal expansion and contraction. Particularly, the slots 72, 76 may be sized to allow relative movement of the axial lips 82, 84 within the respective slots during thermal expansion and contraction. Alternatively, as may be appreciated by those of ordinary skill in the art, the outer and inner dome couplings 66, 68 may have different configurations than what is shown. For example, the upstream end 50, the upstream end 54, or both of the respective wall structures may be configured to include such slot of the coupling, and the inner edge 74, the outer edge 70, or both of the upstream dome may be configured with such axial lip of the coupling to be received by the slot.

FIGS. 5A-5D illustrate an example configuration of the cassette 65 (which will now be referred to the outer cassette 65). The following description will focus on the configuration of the outer cassette 65 that forms a part of the outer wall structure 34. The inner cassette 65' forms a part of the inner wall structure 32. The configuration of the inner cassette 65' will not be described in detail, but would include similar features as described with the outer cassette 65. In some examples, the inner cassette 65' may be a mirror image of the illustrated outer cassette 65. The outer and inner cassettes 65, 65' may be formed in two dimensions having a rectangular cross-section. The axial length of a single cassette is shown spanning between the upstream dome 42 and the turbine nozzle 23. Here, a planar portion 90 of the outer and inner cassettes 65, 65' may be associated with the upstream dome 42, and a tapered portion 91 of the outer and inner cassettes 65, 65' extending in toward the combustion chamber 45 may be associated with the combustor discharge end 59, as shown in FIG. 4. Alternatively, additional cassettes may be provided in alignment or circumferentially offset to one another such that more than one cassette define the axial length of the entire combustor wall structure. For example, more than one cassette may form a part of the planar portion 90 and/or the tapered portion 91. With that being the case, the outer and inner cassettes 65, 65' may have different configurations and cross-sectional shapes depending on the specific location along the combustion chamber 45.

The outer and inner cassettes 65, 65' may be made of materials adapted to withstand relatively-high temperatures produced by the combustion of fuel inside the combustor 30. For example, the outer and inner cassettes 65, 65' may be made from a ceramic matrix composite (CMC). Alternatively, the outer and inner cassettes may be made of other ceramic-containing composite materials and/or of monolithic ceramic materials. The CMC material generally comprises a matrix of resins and a fiber preform embedded within the matrix. The fiber preform of the CMC may comprise any suitable fiber. For example and without limitation, the fiber may be carbon fiber, oxide ceramic fiber, silicon carbide fiber (SiC), and silicon-nitro-carbide (SiNC) fiber. The fiber may be stoichiometric or non-stoichiometric or a combination thereof. It will also be appreciated that the preform or article could consist of any suitable arrangement of fibers including for example and without limitation unidirectional fibers, woven fabric, braided fiber, and the like. It will be appreciated that multiple fiber bundles or tows of the fibers may be formed into 2D or 3D preforms that meet the desired cassette size and shape. The fibers and resins are arranged and cured to form a composite material, which is usually then formed or otherwise machined into a cassette. The outer and inner cassettes 65, 65' may also be made of metal alloys, such as, for example, but not limited to, a steel alloy. The shapes of the cassettes can be casted or processed using direct laser deposition. In some examples, alternate manufacturing methods allow for the incorporation of advanced cooling schemes and/or high temp/strength metal alloys.

The outer and inner cassettes 65, 65' include a cassette body 93 being defined by an upstream edge 94, a downstream edge 96, a first axial edge 98 and a second axial edge 100 interconnected between the upstream edge 94 and the downstream edge 96. The cassette body 93 may have a curvature from the first axial edge 98 to the second axial edge 100 to align with the curvature of the respective outer edge 70 and the inner edge 74 of the upstream dome 42, as shown in FIGS. 3-4. Quenching openings 48 (four shown) are shown extending through the thickness of the cassette body 93 between an outward facing surface 102 and an inward facing surface 104 facing the combustion chamber 45. The upstream edge 94 of the outer and inner cassettes 65, 65' may define at least a portion of the axial lips 82, 84 that are each sized and configured to be received by the corresponding slots 72, 76 of the upstream dome 42. In an example, the upstream edge 94 may be the same thickness along its entire length.

The outer and inner cassettes 65, 65' may be configured to mate, interlock, overlap or otherwise coupled with adjacent cassettes in order to form the annular arrangement that defines each of the inner wall structure 32 and the outer wall structure 34. The annular arrangement of the outer and inner cassettes 65, 65' may define the upstream edge and the downstream edge of the outer and inner wall structures, respectively. In one example, the outer and inner cassettes 65, 65' may be coupled to one another and to the upstream dome 42 and the turbine nozzle 23 with a slip joint and without the use of fasteners. In some instances, fasteners may be used, for example, to couple the outer and inner cassettes to the upstream dome 42. The inner wall structure 32 and the outer wall structure 34 including the outer and inner cassettes 65, 65' contain the hot combustion products, which may exceed 3000° F. (1650° C.), and provide a flow path suitable for efficient combustion.

Figure 5A:
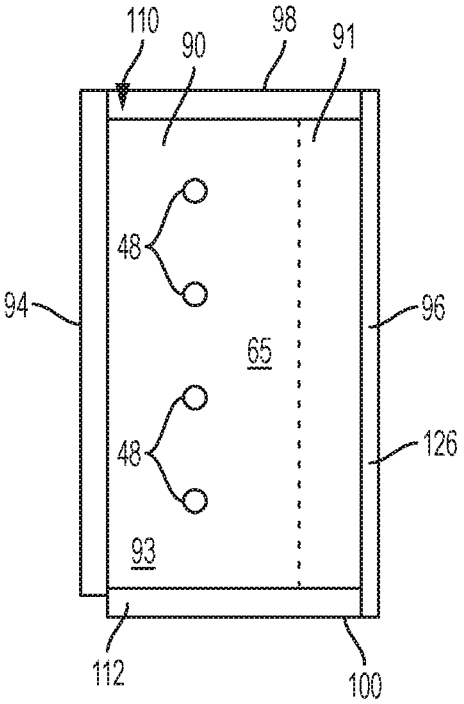
FIGS. 5A-5D are various views of a combustor cassette.
Figure 5B:
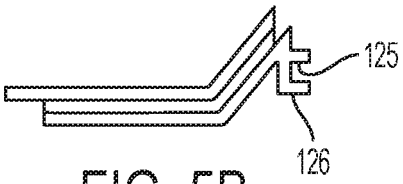
Figure 5C:
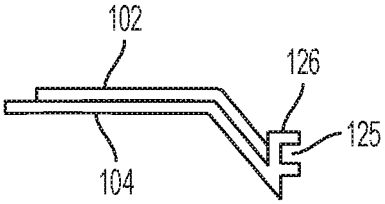

The outer and inner cassettes 65, 65' are each shown in FIGS. 5A and 6D including a first mating feature 110 and a second mating feature 112 that is structurally complementary to the first mating feature 112 to form a coupling. In the example shown, the first axial edge 98 of the outer and inner cassettes 65, 65' includes the first mating feature 110 that would couple to the second mating feature 112 of the second axial edge 100 of the adjacent outer or inner cassette 65, 65'. The second axial edge 100 of the outer and inner cassettes 65, 65' includes the second mating feature 110 that would couple to the first mating feature 110 of the first axial edge 98 of the adjacent outer cassette 65. To this end, the outer and inner cassettes 65, 65' when coupled to one another may be adapted to thermally expand and contract in the axial direction. The outer and inner cassettes may also be coupled to allow for thermal expansion and contraction in the circumferential and/or radial direction.

Figure 5D:
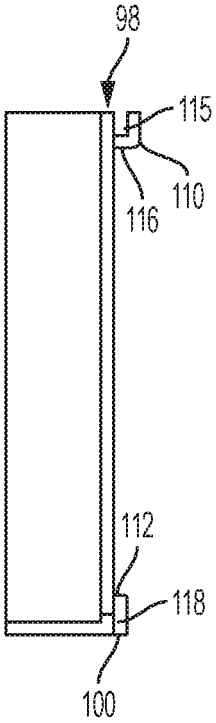

In the example shown in FIG. 4 and FIG. 5D, the first mating feature 110 may be defined by a slot 115 formed in the first axial edge 98. The first axial edge 98 may include an edge flange 116 in the form of a thickened region relative to the general thickness of the cassette body 93. The slot 115 may be formed in the edge flange 116 to define a U-shaped cross-section. The second mating feature 112 may be defined by at least a portion of the second axial edge 100 raised or elevated relative to the plane of the cassette body 93 to define a tab 118 sized, shaped, and positioned to be received into the slot 115 of an adjacent cassette. As shown, the edge flange 116 may extend along the first axial edge 98 and terminate short of its full length and the tab 118 may extend along the second axial edge 100 and terminate short of its full length, where the respective upstream edge 94 is located. To this end, when several outer and inner cassettes 65, 65' are coupled to one another, the respective axial lip 82 formed by the upstream edge 94 form a more uniform and continuous axial lip 82 for coupling to the upstream dome 42 without the edge flange 116 and the tab 118 projecting into the zone of the axial lip 82.

In FIGS. 5A-SC, the downstream edge 96 of the outer and inner cassettes 65, 65' includes a downstream edge flange 126 in the form of a thickened region relative to the general thickness of the cassette body 93. A slot 125 may be formed in the edge flange 126, extending upstream therein, such that the edge flange 116 includes a U-shaped cross-section. The slot 125 may also be referred to as being formed in the downstream end 56 and/or 52 of the outer wall and inner wall structures 34, 32, respectively. The downstream edge flange 126 may extend along the entire length of the downstream edge 96.

Figure 6:
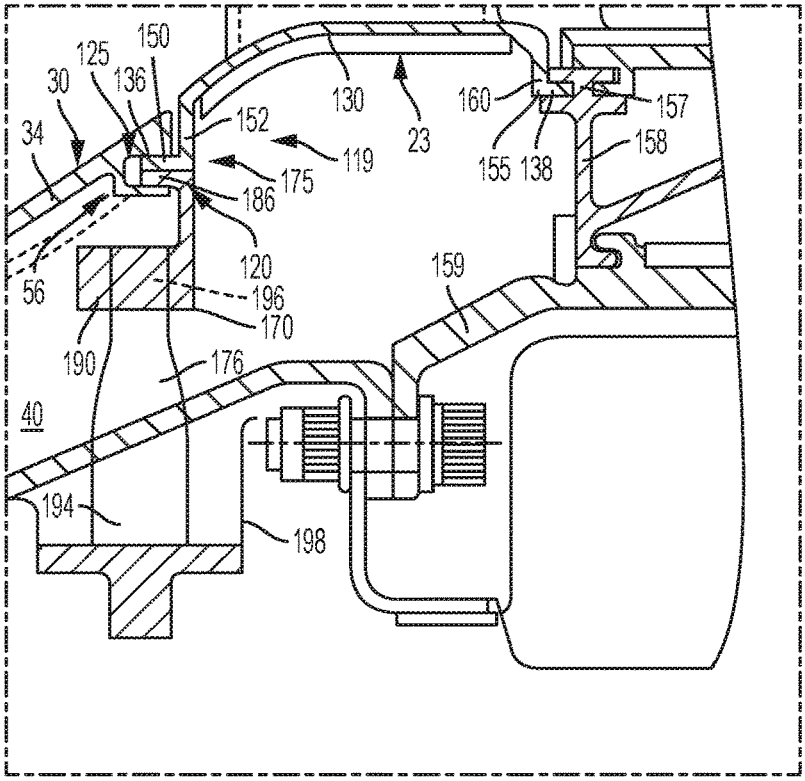
FIG. 6 illustrates a magnified view of a coupling between a combustor, a ring mount, and a turbine nozzle.

With reference to FIGS. 2 and 6, the combustor 30 may be coupled to the turbines (the first being the high pressure turbine 22) via the turbine nozzle 23, to define a combustor and turbine nozzle assembly 119, that passes through combustion products from the combustor 30 and to the turbines. For example, an outer nozzle coupling 120 and an inner nozzle coupling 122 may be formed between portions of the turbine nozzle 23 and the inner wall structure 32 and the outer wall structure 34.

The turbine nozzle 23 may be defined by an outer nozzle shroud 130 and an inner nozzle shroud 132. The outer nozzle shroud 130 and the inner nozzle shroud 132 may be each constructed from a metallic material and have a tubular shape. The outer nozzle shroud 130 extends axially downstream along the longitudinal axis (X-X) of the engine 10 from a first or upstream end 136 to a second or downstream end 138. The inner nozzle shroud 132 extends axially downstream along the longitudinal axis (X-X) of the engine 10 from a first or upstream end 140 to a second or downstream end 142. The upstream ends 136, 140 of the outer nozzle shroud 130 and the inner nozzle shroud 132 together define a nozzle inlet 145. The downstream ends 138, 142 of the outer nozzle shroud 130 and the inner nozzle shroud 132 together define a nozzle discharge 147. To this end, the nozzle inlet 145 and the combustor discharge end 59 are adapted for a secure mechanical fit to inhibit leakage of the combustion products and to allow from thermal expansion and contraction. The shrouds 130, 132 may be shaped with an inwardly tapered portion from the upstream end to an axial portion such that the cross-sectional area of the nozzle inlet 145 is greater than the cross-sectional are of the nozzle discharge 147.

The downstream ends 52, 56 of the inner wall structure 32 and the outer wall structure 34, respectively, have radial support means with the turbine nozzle 23 to provide radial support and allow for thermal growth of the inner and outer wall structures 32, 34. In one example, the downstream edge 96 of the cassette body 93 of the cassette 65, 65' may be adapted to couple to a portion of the turbine nozzle 23, as will be described, at the outer nozzle coupling 120 and the inner nozzle coupling 122, respectively. The upstream end 136 of the outer nozzle shroud 130 may be formed to include an axial nozzle lip 150 to be received in a slot formed in the downstream end 56 of the outer wall structure 34, shown as the slot 125 formed in the downstream edge 96 of the outer cassette 65, to form the outer nozzle coupling 120. A radially outward flange 152 may be included along the upstream end 136 of the outer nozzle shroud 130, from which the axial nozzle lip 150 may be extended upstream. The radially outward flange 152 may be engageable with the axial end surface of the downstream end 56 of the outer wall structure 34. The downstream end 138 of the outer nozzle shroud 130 may be formed to include an axial nozzle lip 155 to be received in a slot 157 formed in an annular support 158 extended between and coupled to a turbine casing 159. A radially outward flange 160 may be included along the downstream end 138 of the outer nozzle shroud 130, from which the axial nozzle lip 155 may be extended downstream.

Figure 8:
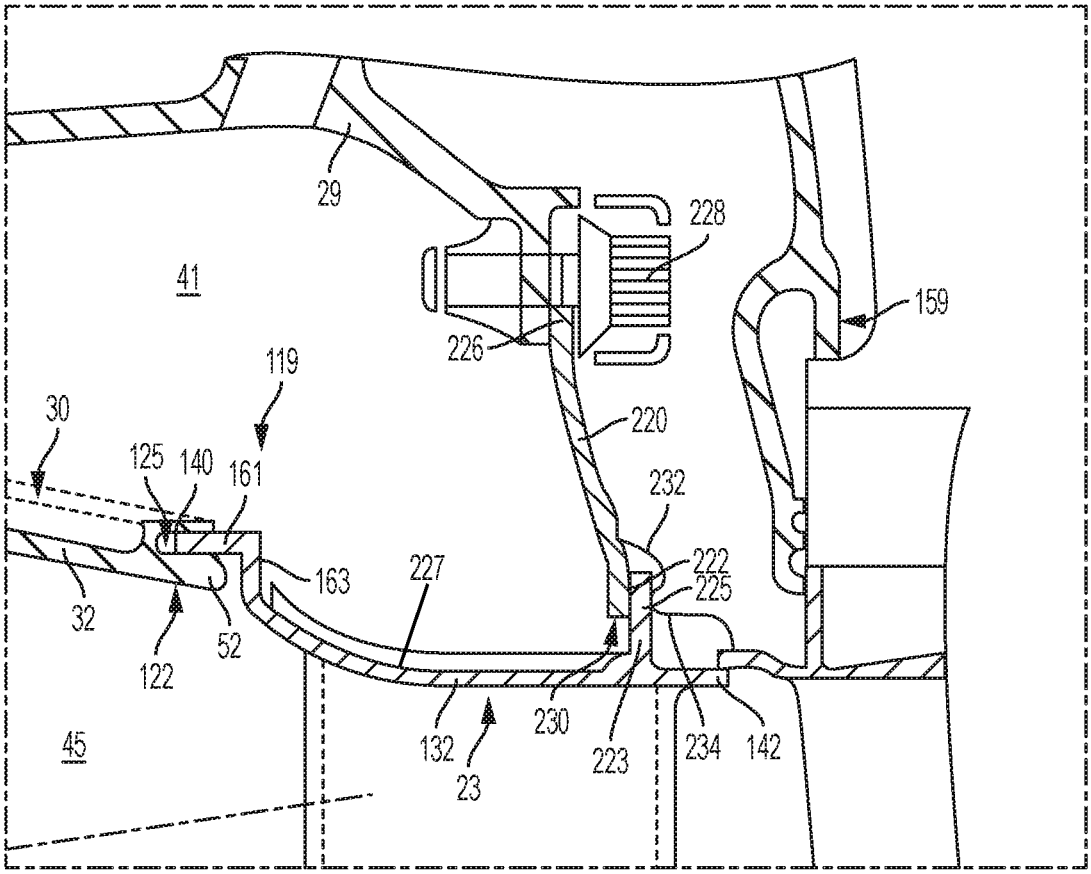
FIG. 8 illustrates a magnified view of a seal coupled to a turbine nozzle.

With reference to FIGS. 2 and 8, the upstream end 140 of the inner nozzle shroud 132 may be formed to include an axial nozzle lip 161 to be received in a slot formed in the downstream end 52 of the inner wall structure 32, shown as the slot 125 formed in the downstream edge 96 of the inner cassette 65', to form the inner nozzle coupling 122. A radially outward flange 163 may be included along the upstream end 140 of the inner nozzle shroud 132, from which the axial nozzle lip 161 may be extended upstream. The radially outward flange 163 may be engageable with the axial end surface of the downstream end 52 of the inner wall structure 32. The downstream end 142 of the inner nozzle shroud 132 may be coupled to the turbine casing 159. The slots 125 of the outer cassette 65 and the inner cassette 65' may be sized to allow relative movement of the axial nozzle lips 150, 161 and the axial flange 186 of the ring mount 170 within the respective slots during thermal expansion and contraction.

Figure 7:
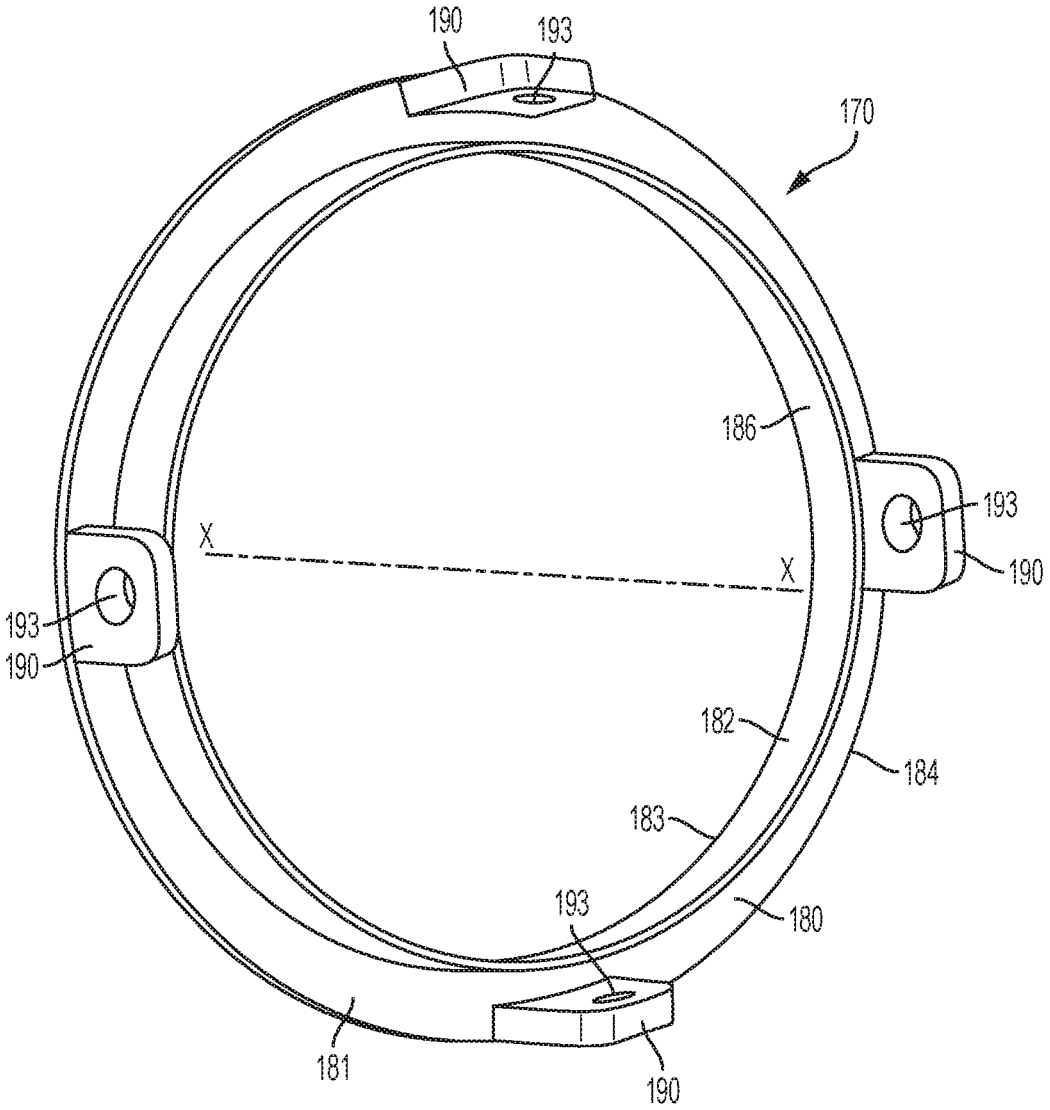
FIG. 7 is a perspective view of a ring mount.

With reference to FIGS. 2, 6 and 7, a ring mount 170 may be included along the downstream edge 96 of the outer cassette 65 and/or the upstream end 136 of the outer nozzle shroud 130. The ring mount 170 may run within the outer plenum 40, surrounding the outer nozzle coupling 120 between the combustor 30 and the turbine nozzle 23. The ring mount 170 may facilitate the radial support of the combustor and turbine nozzle assembly 119 at the outer nozzle coupling 120 and further strengthen the hoop integrity of the combustor wall 31 comprising the outer cassettes 65. To this end, a joint assembly 175 may be formed by the outer nozzle coupling 120, between the downstream edge 96 of the outer cassette 65 and the upstream end 136 of the outer nozzle shroud 130, and the ring mount 170. As will be described, the joint assembly 175 may include a mount stake 176 extending between the outer casing 27 and the ring mount 170.

With additional reference to FIG. 7, an example of the ring mount 170 may include an annular body 180 having an inner edge 182 and an outer edge 184 radially disposed from one another. An upstream facing surface 181 and a downstream facing surface 183 are disposed axially from one another to define the thickness of the annular body 180. The annular body 180 may be modified for lighter weight and increased rigidity, such as, for example, including stiffening ridges and/or perforations. An axial flange 186 may be included along the annular body 180 of the ring mount 170. For example, the inner edge 182 is shown including the axial flange 186. The axial flange 186 may be extended upstream from the upstream facing surface 181 of the annular body 180 (as shown), or alternatively, may be extended downstream from the downstream facing surface 183 depending on the joint assembly configuration. In an example, the axial flange 186 may be orthogonal to the annular body 180 to define a L-shaped body. For example, the annular body 180 may be extended orthogonal to the longitudinal axis (X-X), while the axial flange 186 may be extended parallel to the longitudinal axis (X-X). The ring mount 170 may be a continuous shape to define a full annular member. Alternatively, the ring mount 170 may be segmented, where a plurality of arcuate members may form the ring mount.

In one example, the joint assembly 175 may be formed by the outer nozzle coupling 120, that is, the axial nozzle lip 150 formed by the upstream end 136 of the outer nozzle shroud 130 received in the slot 125, and the axial flange 186 of the ring mount 170 received in the slot 125 in an overlapping relationship with the axial nozzle lip 150. In an example, the slot 125 may receive both the of the axial nozzle lip 150 and the axial flange 186, disposed radially outward to the axial nozzle lip 150. In one example, the size of the slot 125 formed in the outer cassette 65 may be larger than the size of the slot 125 that is formed in the inner cassette 65' in order to accommodate and receive the axial nozzle lip 150 of the outer nozzle shroud 130 and the axial flange 186 of the ring mount 170.

When the outer and inner cassettes 65, 65' are properly coupled to one another to define the inner and outer wall structures 32, 34 and coupled to the upstream dome 42 and turbine nozzle 23, the combustor 30 may be mounted to the outer casing 27 at a plurality of mounting locations. For example, as shown in FIG. 2, the mounting stake 176 may be coupled to the ring mount 170 that is coupled to the outer wall structure 34 and the outer casing 27. As will be described later, a dome mounting stake 208 may be coupled to an upstream facing surface 210 (as shown) of the upstream dome 42. In other embodiments, other methods of fastening the outer wall structure 34 to the outer casing 27 may be implemented consistent with the spirit of the present disclosure.

A plurality of mounting bosses 190 may be provided along the upstream facing surface 181 (as shown) and/or the downstream facing surface 183 of the annular body 180. In an example, the mounting bosses 190 may be disposed along the upstream facing surface 181 at one location of the ring mount 170 and the downstream facing surface 183 at another location of the ring mount 170. The mounting bosses 190 have a body that may extend along the longitudinal axis (X-X). A mounting aperture 193 may be formed in the body of the mounting boss 190 to extend through the thickness of the body. The mounting aperture 193 may extend perpendicular to the longitudinal axis (X-X). The number of mounting bosses 190 may be three to four, but may be more or less depending on the design. The mounting bosses 190 may be circumferentially spaced from one another. In an example, the spacing between adjacent mounting bosses 190 may be equal. For example, 3 mounting bosses 190 would be spaced 120 degrees apart, while 4 mounting bosses 190 would be spaced 90 degrees apart. The mounting bosses 190 may be separate elements welded, soldered, or otherwise attached to the ring mount 170, integrally formed such as, for example, by casting, or otherwise manufactured and mounted to the ring mount 170.

With reference to FIGS. 2 and 6, the mounting stakes 176 may be extended between the mounting bosses 190 and the outer casing 27. The number of mounting stakes 176 corresponds to the number of mounting bosses 190 such that each mounting stake 176 may be associated with and coupled to a corresponding mounting boss 190. In one example, the mounting stake 176 may include an elongated body having a mounting base 194 and a mounting tip 196. The mounting stake body may have tapered portion tapering inwardly approximate the mounting tip 196. The mounting base 194 may be secured to the outer casing 27 in a fixed manner. For example, the mounting base 194 may be coupled within a recess 198 formed in the outer casing 27, where the recess 198 may be extended outward from the plenum 40.

The mounting tip 196 may be adapted to be received in the mounting aperture 193 of the mounting boss 190. The interface between the mounting tip 196 of the mounting stake 176 and the mounting aperture 193 of the mounting bosses 190 may allow for thermal expansion and contraction. In one example, the mounting stake 176 may be positioned within the outer casing 27 to extend orthogonal to the longitudinal axis (X-X).

With reference to FIGS. 2-3, a plurality of dome mounting bosses 205 (four shown) may be provided along the upstream facing surface 210 (as shown) of the upstream dome 42. The dome mounting bosses 205 have a body that may extend along the longitudinal axis (X-X). A dome mounting aperture 206 may be formed in the body of the dome mounting boss 205 to extend through the web thickness of the body. The dome mounting aperture 206 may extend perpendicular to the longitudinal axis (X-X). The number of dome mounting bosses 205 may be three to four, but may be more or less depending on the design. The dome mounting bosses 205 may be circumferentially spaced from one another. In an example, the spacing between adjacent dome mounting bosses 205 may be equal. For example, three dome mounting bosses 205 would be spaced 120 degrees apart, while four dome mounting bosses 205 would be spaced 90 degrees apart. The dome mounting bosses 205 may be separate elements welded, soldered, or otherwise attached to the upstream dome 42, integrally formed such as, for example, by casting, or otherwise manufactured and mounted to the upstream dome 42.

With additional reference to FIG. 2, dome mounting stakes 208 may be extended between the dome mounting bosses 205 and the outer casing 27. The number of mounting stakes 208 corresponds to the number of dome mounting bosses 205 such that each dome mounting stake 208 may be associated with and coupled to a corresponding dome mounting boss 205. In one example, the dome mounting stake 208 may include an elongated body having a mounting base 211 and a mounting tip 212. The dome mounting stake body may have tapered portion tapering inwardly approximate the mounting tip 212. The mounting base 211 may be secured to the outer casing 27 in a fixed manner. For example, the mounting base 211 may be coupled within a recess 213 formed in the outer casing 27, where the recess 213 may be extended outward from the plenum 40. The mounting tip 212 may be adapted to be received in the dome mounting aperture 206 of the dome mounting boss 205. The interface between the mounting tip 212 of the dome mounting stake 208 and the dome mounting aperture 206 of the dome mounting bosses 205 may allow for thermal expansion and contraction. In one example, the dome mounting stake 208 may be positioned within the outer casing 27 to extend orthogonal to the longitudinal axis (X-X).

As the inner wall structure 32 and the outer wall structure 34 radially expands and contracts in response to the thermal cycle operation of gas turbine engine 10, the ring mount 170 will be correspondingly displaced in a radial direction. Since the outer casing 27 and the inner casing 29 may have a higher coefficient of thermal expansion and/or thermal mass, the outer casing 27 and the inner casing 29 may thermally expand and contract at a slower rate than the combustor wall 31. To compensate for this variation in radial expansion and contraction, the mounting tips 196, 212 of the respective mounting stakes 176, 208 are slidably displaced along the length of the corresponding mounting apertures 193, 206 of the mounting bosses 190, 205. This can permit relative radial displacement between the ring mount 170 that is coupled to the outer wall structure 34 and the mounting stake 176, and the upstream dome 42 and the dome mounting stake 208.

Referring to FIGS. 2 and 8, an annular seal 220 may be supported between the inner casing 29 and an inner portion of the turbine nozzle 23. The seal 220 defines an annular sealing surface 222 which may be engaged against an upstream facing surface 223 of an annular radial protrusion 225 extending from the inner nozzle shroud 132 to seal off fluid flow between cooling air from the inner annular plenum 41 and the combustion chamber 45 via the turbine nozzle 23. The radial protrusion 225 may be located along an outward facing surface 227 of the inner nozzle shroud 132 that faces the inner plenum 41 between the upstream end 140 and the downstream end 142, and in some examples, in close proximity to or proximate the downstream end 142 of the inner nozzle shroud 132, as shown. It should be understood that the terms "seal" and "sealing" used herein are intended to have a broad meaning that includes a reduction in the passage of air, and do not necessarily require a one hundred percent reduction in fluid flow, unless specifically provided to the contrary. Particularly, the seal 220 may be supported along an inner edge 226 of the seal 220 via a plurality of fasteners or pins 228. An outer edge 230 of the seal 220 may include a ring clip 232. The ring clip 232 may be attached along the annular sealing surface 222 of the seal 220. The ring clip 232 may have a spring-biased engageable portion 234 configured to extend downstream away from the annular sealing surface 222 in order to capture the web thickness of the radial protrusion 225. During axial thermal expansion and contraction of the turbine nozzle 23, the radial protrusion 225 will deflect or pivot the seal 220 about the fasteners 228, thus maintaining engagement with the annular sealing surface 222. Similarly, during radial thermal expansion and contraction of the turbine nozzle 23, the radial protrusion 225 will slide radially along the annular sealing surface 222, thus maintaining the seal therebetween. The clip ring 232 may be adapted to aid in maintaining the engagement and seal between the radial protrusion 225 and the seal 220.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments have been described, it will be apparent to those of ordinary skill in the art that many more embodiments and implementations are possible.

Accordingly, the embodiments described herein are examples, not the only possible embodiments and implementations.

Furthermore, the advantages described above are not necessarily the only advantages, and it is not necessarily expected that all of the described advantages will be achieved with every embodiment.

What is claimed is:

1. An assembly for a gas turbine engine, the assembly being disposed about a longitudinal axis and comprising:

a combustor having an inner casing and an outer casing and a combustor wall positioned between the inner and outer casings, respectively, the combustor wall including an inner wall, an outer wall, and an upstream dome coupled to the outer wall and the inner wall, the outer wall extending along the longitudinal axis between an upstream end and a downstream end;

a turbine nozzle defined by an inner nozzle shroud and an outer nozzle shroud, the outer nozzle shroud extending downstream between a nozzle upstream end and a nozzle downstream end; and a ring mount including an inner edge and an outer edge, the inner edge coupled to the downstream end of the outer wall and to the nozzle upstream end of the outer nozzle shroud, the outer edge coupled to the outer casing, wherein the ring mount includes an axial flange extending upstream, and wherein the nozzle upstream end of the outer nozzle shroud includes an axial nozzle lip extending upstream in an overlapping relationship with the axial flange of the ring mount, the downstream end of the outer wall including a slot sized to receive both of the axial nozzle lip of the outer nozzle shroud and the axial flange of the ring mount.

2. The assembly of claim 1, wherein the outer wall comprises a plurality of outer combustor cassettes coupled to one another in an outer annular arrangement.

3. The assembly of claim 2, wherein the outer annular arrangement of the plurality of outer combustor cassettes defines the upstream end and the downstream end of the outer wall.

4. The assembly of claim 3, wherein the upstream end of the outer wall defines an axial lip, and an outer edge of the upstream dome includes a slot configured to receive the axial lip of the outer wall.

5. The assembly of claim 4, wherein the inner wall comprises a plurality of inner combustor cassettes coupled to one another in an inner annular arrangement, and the inner annular arrangement of the combustor cassettes defines an upstream end and a downstream end of the inner wall, wherein the upstream end of the inner wall defines an axial lip, and an inner edge of the upstream dome includes a slot configured to receive the axial lip of the inner wall.

6. The assembly of claim 1, wherein the outer wall comprises a plurality of combustor cassettes coupled to one another in an annular arrangement, wherein the annular arrangement of the plurality of combustor cassettes defines the downstream end of the outer wall.

7. The assembly of claim 1, wherein the ring mount includes an annular body having the inner edge and the outer edge, the inner edge including the axial flange extending upstream from the annular body, a plurality of mounting bosses circumferentially spaced from one another and extending upstream from an upstream facing surface of the annular body, the assembly further comprising a plurality of mounting stakes, each mounting stake associated with and coupled to a corresponding mounting boss of the plurality of mounting bosses.

8. The assembly of claim 1, wherein the inner wall extends along the longitudinal axis between an upstream end and a downstream end, wherein the inner nozzle shroud extends between the nozzle upstream end and the nozzle downstream end, the nozzle upstream end of the inner nozzle shroud including an axial flange extending upstream, the downstream end of the inner wall including a slot sized to receive the axial flange of the inner nozzle shroud.

9. The assembly of claim 1, wherein a radial protrusion extends away from a surface of the inner nozzle shroud that faces the inner casing, the assembly further comprising a seal having a sealing surface engaging an upstream surface of the radial protrusion.

10. The assembly of claim 9, wherein the seal is shaped as an annular seal having an inner edge coupled to the inner casing and an outer edge of the seal is coupled to the radial protrusion.

11. A gas turbine engine disposed about a longitudinal axis, comprising:

a combustor to receive compressed air from a compressor, the combustor including a casing, an upstream dome coupled to each of an inner wall and an outer wall spaced from the casing, the outer wall comprising a plurality of combustor cassettes coupled to one another in an annular arrangement to define an upstream end and a downstream end of the outer wall;

a turbine disposed downstream of the combustor to receive combustion products from the combustor through a turbine nozzle, the turbine nozzle defined by an inner nozzle shroud and an outer nozzle shroud, the outer nozzle shroud having a nozzle upstream end; and a ring mount and a mount stake, the ring mount coupled to both of the downstream end of the outer wall and the nozzle upstream end of the outer nozzle shroud, the mount stake coupled between the ring mount and the casing, wherein the downstream end of the outer wall includes a slot configured to receive an axial lip formed along the nozzle upstream end of the outer nozzle shroud and an axial flange of the ring mount extending upstream from the ring mount.

12. The gas turbine engine of claim 11, wherein the ring mount includes an annular body and a plurality of mounting bosses extending from the annular body of the ring mount, wherein the mount stake is a first mount stake coupled between a first mounting boss of the plurality of mounting bosses of the ring mount and the casing, the gas turbine engine further comprising a second mount stake circumferentially spaced from the first mount stake, wherein the second mount stake is coupled between a second mounting boss of the plurality of mounting bosses and the casing.

13. The gas turbine engine of claim 11, wherein the inner wall comprises a plurality of combustor cassettes coupled to one another in an annular arrangement to define an upstream end and a downstream end of the inner wall.

14. The gas turbine engine of claim 13, wherein the upstream dome includes an inner edge and an outer edge, each of the inner edge and the outer edge including a slot, wherein the slot of the outer edge of the upstream dome is configured to receive the upstream end of the outer wall, and the slot of the inner edge of the upstream dome is configured to receive the upstream end of the inner wall.

15. An assembly for a gas turbine engine, comprising:

a combustor including an outer casing and a combustor wall positioned relative to the outer casing to define an outer plenum, the combustor wall including an outer wall, an inner wall, and an upstream wall coupled to the outer wall and the inner wall, each of the outer wall and the inner wall comprising a plurality of combustor cassettes coupled to one another in an annular arrangement to define an upstream end and a downstream end of the outer wall and the inner wall, respectively;

a turbine nozzle including an inner nozzle shroud and an outer nozzle shroud each extending between a nozzle upstream end and a nozzle downstream end; and a ring mount and a plurality of mount stakes, the ring mount having an inner edge and an outer edge, wherein the downstream end of the outer wall is coupled to the nozzle upstream end of the outer nozzle shroud and the inner edge of the ring mount, and the downstream end of the inner wall is coupled to the nozzle upstream end of the inner nozzle shroud, wherein the plurality of mount stakes are circumferentially spaced from one another and coupled between the outer edge of the ring mount and the outer casing, wherein the ring mount includes an axial flange extending upstream along the inner edge of the ring mount, and wherein the downstream end of the outer wall includes a slot to receive both of the nozzle upstream end of the outer nozzle shroud and the axial flange of the ring mount.

16. The assembly of claim 15, further comprising a plurality of mounting bosses extending upstream along the outer edge of the ring mount, wherein each of the plurality of mount stakes includes a mounting tip coupled within a mounting aperture of a corresponding mounting boss of the plurality of mounting bosses.

17. The assembly of claim 16, wherein the inner nozzle shroud includes an axial nozzle lip formed along the nozzle upstream end of the inner nozzle shroud and a radial protrusion extending away from an outward facing surface of the inner nozzle shroud, the assembly further comprising a seal having a sealing surface engaging an upstream surface of the radial protrusion.

* * * * *